US009863161B2

(12) United States Patent
Anderson

(10) Patent No.: US 9,863,161 B2
(45) Date of Patent: Jan. 9, 2018

(54) FOUNDATIONLESS TOWER ASSEMBLY

(71) Applicant: Wilbur L. Anderson, Inc., San Angelo, TX (US)

(72) Inventor: Charles Anderson, San Angelo, TX (US)

( * ) Notice: Subject to any disclaimer, the term of this patent is extended or adjusted under 35 U.S.C. 154(b) by 0 days.

(21) Appl. No.: 14/595,364

(22) Filed: Jan. 13, 2015

(65) Prior Publication Data

US 2015/0197957 A1 Jul. 16, 2015

Related U.S. Application Data

(60) Provisional application No. 61/927,108, filed on Jan. 14, 2014.

(51) Int. Cl.

| | |
|---|---|
| ***E04H 12/22*** | (2006.01) |
| ***E02D 27/02*** | (2006.01) |
| ***E02D 27/42*** | (2006.01) |
| ***H01Q 1/12*** | (2006.01) |
| *E04H 12/34* | (2006.01) |

(52) U.S. Cl.

CPC ..... *E04H 12/2246* (2013.01); *E02D 27/02* (2013.01); *E02D 27/42* (2013.01); *H01Q 1/1242* (2013.01); *E04H 12/2253* (2013.01); *E04H 12/2261* (2013.01); *E04H 12/34* (2013.01); *E04H 12/345* (2013.01); *E04H 12/347* (2013.01)

(58) Field of Classification Search

CPC ..... E02D 27/42; E02D 27/02; E04H 12/2246; E04H 12/34; E04H 12/2253; E04H 12/2261; E04H 12/345; E04H 12/347

USPC ..... 52/79.5; 343/880, 881, 883, 890

See application file for complete search history.

(56) References Cited

U.S. PATENT DOCUMENTS

| | | | | |
|---|---|---|---|---|
| 3,794,279 | A * | 2/1974 | Kramer | E04H 12/2246 248/160 |
| 4,649,675 | A * | 3/1987 | Moldovan et al. | 52/27 |
| 4,776,140 | A * | 10/1988 | Wight et al. | 52/125.5 |
| 4,811,530 | A * | 3/1989 | Eyerly | 52/6 |
| 5,531,419 | A * | 7/1996 | Gustafsson et al. | 248/519 |
| 5,765,316 | A * | 6/1998 | Kavarsky | 52/67 |
| 5,782,042 | A * | 7/1998 | Klein | 52/116 |
| 6,199,818 | B1 * | 3/2001 | Tsappi | A01G 9/124 248/516 |
| 6,464,196 | B1 * | 10/2002 | Crookham et al. | 248/519 |
| 6,888,512 | B1 * | 5/2005 | Daigler | 343/878 |

(Continued)

FOREIGN PATENT DOCUMENTS

| | | | | |
|---|---|---|---|---|
| FR | 2666865 | A1 * | 3/1992 | E04H 12/2246 |
| GB | 2436573 | A * | 10/2007 | E04H 12/08 |
| WO | WO 2009013547 | A2 * | 1/2009 | E04H 12/22 |

*Primary Examiner* — Adriana Figueroa

(74) *Attorney, Agent, or Firm* — Jackson Walker LLP

(57) ABSTRACT

A tower assembly having a tower, the tower assembly for maintaining the tower in a vertically upright position wherein the tower nor any part of the tower assembly penetrates the ground on which the tower is disposed. The tower of the tower assembly has a near end and a removed end, the near end being attached to a tray having a flat floor and upstanding vertical perimeter side walls. A mounting assembly mounts the tower to the tray. A ballast, typically comprising multiple small stones, is provided for laying on top of the flat floor of the tray, so as to provide sufficient weight to prevent the tower from tipping over.

21 Claims, 10 Drawing Sheets

(56) References Cited

U.S. PATENT DOCUMENTS

| | | | | |
|---|---|---|---|---|
| 6,889,953 | B2 * | 5/2005 | Harbaugh | E04H 12/2246 135/16 |
| 7,089,705 | B1 * | 8/2006 | Lieberman | 52/146 |
| 7,098,864 | B2 * | 8/2006 | Ryan | 343/890 |
| 8,317,226 | B1 * | 11/2012 | Wong | 280/769 |
| 8,319,697 | B2 * | 11/2012 | Conrad | H01Q 1/08 343/840 |
| 8,960,615 | B1 * | 2/2015 | Johnson et al. | 248/188.7 |
| 2002/0028716 | A1 * | 3/2002 | Gormley | E04H 12/2246 473/423 |
| 2002/0149536 | A1 * | 10/2002 | Safakhah | 343/882 |
| 2004/0069922 | A1 * | 4/2004 | Wu | 248/519 |
| 2012/0228442 | A1 * | 9/2012 | Clifton | 248/163.1 |
| 2013/0146740 | A1 * | 6/2013 | Ma | E04H 12/2246 248/519 |
| 2014/0059957 | A1 * | 3/2014 | Stark | 52/292 |

* cited by examiner

TOP VIEW - SECTIONS SEPARATE

TOP VIEW

DIAGONAL BRACE 1
64
SQ. TUBE MOUNTING BRACE
DIAGONAL BRACE 2
66
72
14
PTMW CASE
20
CHANNEL GRATING (NOT FULLY SHOWN)
SQ. TUBE FRAME
TOP VIEW DETAIL

DIAGONAL BRACE 1
64
DIAGONAL BRACE 2
66
PTMW CASE
20
DIAGONAL BRACE 2
66
SQ. TUBE MOUNTING BRACE
SQ. TUBE FRAME
CHANNEL GRATING
14
60' TILT TOWER
12
DIAGONAL BRACE 2
66

FRONT VIEW (NO ANTENNAS)

FOUNDATIONLESS TOWER ASSEMBLY

This is a utility patent application, which claims the benefit of and priority to U.S. Application Ser. No. 61/927,108, filed Jan. 14, 2014. The following applications are herein incorporated by reference: US Patent Publication No. 2012/0291368, published Nov. 22, 2012; and U.S. patent application Ser. No. 13/870,290, filed Apr. 25, 2013, U.S. Pat. No. 8,863,450.

FIELD OF THE INVENTION

A foundationless tower assembly, more specifically, a tower supported by a ballast receiving tray resting on, but not penetrating, the ground.

BACKGROUND OF THE INVENTION

Typically, towers and other similar devices, such as towers for supporting an antenna at a removed end thereof, have foundations. Foundations penetrate the ground and are typically made of concrete. They provide stability because of a firm engagement of the tower to the ground. Towers, because of their elongated nature, have inherent instability, and need to be securely engaged with the ground or other support surface.

In some cases, it may not be possible to penetrate the ground, either for practical reasons or for political considerations. In such a case, where a tower needs to be erected, it may be useful to provide a support assembly for a tower that does not require disturbing the ground.

SUMMARY OF THE INVENTION

Applicant provides various embodiments of a tower assembly comprising a tower having a near and a removed end, the removed end for engaging an antenna and a near end adjacent the ground for engaging a tray resting on the ground. The tray is typically constructed with a flat floor and low or high upright side walls, and is designed to receive ballast, such as dirt, soil, a multiplicity of stones or rocks, or other suitable structures thereon. With a tray of sufficient size and stoutness, and with ballast received thereon and/or therein, a suitable foundationless support may be provided for the tower assembly, the support laying on the surface of the ground and not disturbing the ground.

One particular embodiment of Applicant's tray includes a mounting assembly for engaging the tower to the tray, which mounting assembly has a leveling mechanism for maintaining the axis of the tower vertical with respect to a generally horizontal support surface.

In another embodiment, Applicant provides for a tray that includes a breakdown assembly adapted to provide for ease of shipment and minimizing at least one long dimension of a tray.

A tower assembly comprising a tower having a near end and a removed end; a tray having a flat floor and upstanding vertical perimeter side walls; and a mounting assembly for engaging the tower to the tray, a ballast comprising multiple stones for laying on top of the flat floor of the tray; wherein the mounting assembly has leveling members; wherein the leveling members include multiple fasteners; wherein the leveling members include a plate at the near end of the tower and a plate engaging the tray; wherein the tower comprises a single mast; wherein the single mast includes a swing tube and antenna; wherein the tray includes a rectangular perimeter and multiple members defining cross members; wherein the tray includes a first portion and a second portion, the two portions removably attached with fasteners; wherein the two portions include cooperating telescoping members; wherein the tray includes a rectangular perimeter and multiple members defining cross members; and wherein the tray includes a first portion and a second portion, the two portions removably attached with fasteners. The tower assembly further may include a flexible member for engaging the tray and substantially covering the ballast, further may include rigid diagonal braces for engaging the tray to the mast, the ballast may be railroad ballast.

A tower assembly comprising a tower having a near end and a removed end, a tray having a flat floor and upstanding vertical perimeter side walls; and a mounting assembly for engaging the tower to the tray, a ballast comprising multiple stones for laying on top of the flat floor of the tray; wherein the mounting assembly has leveling members; wherein the tower comprises a single mast; wherein the single mast includes a swing tube and antenna; wherein the tray includes a rectangular perimeter and multiple members defining cross members; and wherein the tray includes a first portion and a second portion, the two portions removably attached with fasteners, further including a flexible member for engaging the tray and substantially covering the ballast, further including rigid diagonal braces for engaging the tray to the mast; wherein the mounting assembly has leveling members; wherein the leveling members include multiple fasteners; wherein the leveling members include a plate at the near end of the tower and a plate engaging the tray; and wherein the ballast is railroad ballast.

DETAILED DESCRIPTION OF THE PREFERRED EMBODIMENT

Figure 1:
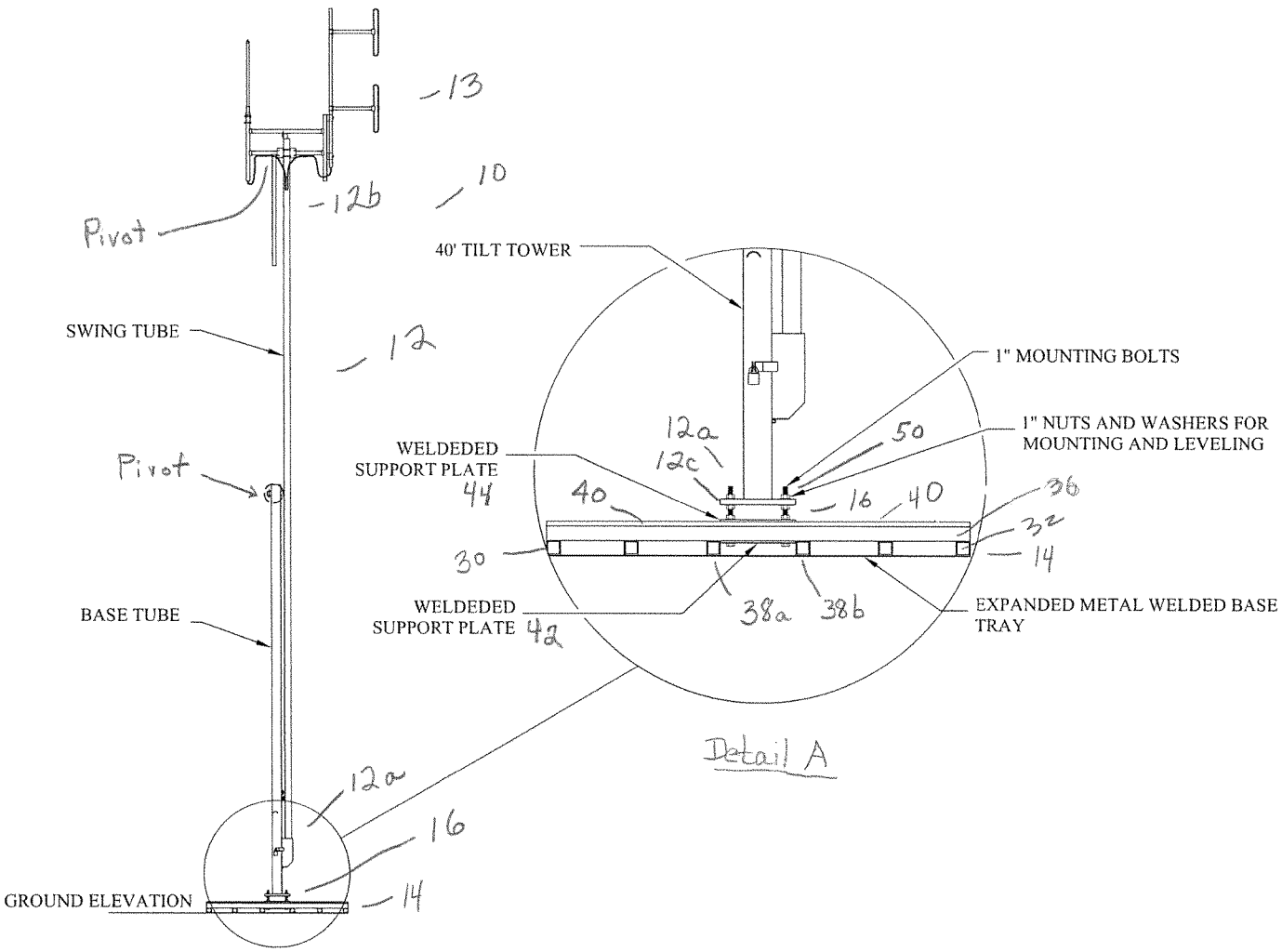
FIGS. 1 and 1 Detail A illustrate a side elevational view of the tower assembly, including details of a mounting assembly for mounting the tower of the tower assembly to a tray.

The Figures illustrate a tower assembly 10 for erecting upon ground which ground cannot be disturbed or dug into. Tower assembly 10 may include a vertical tower 12 having a near end 12*a* and a removed end 12*b*, the removed end which may include a baseplate 12*c* as, for example ¼ inch metal plate. In one embodiment, a pivotable antenna 13 may be provided at or near the removed end of the tower, the antenna for communication (send and/or receive) to and from a remote location, in one embodiment, the antenna for railroads. In one embodiment, the tower is a monopole and in another embodiment includes a base tube/swing tube combination (see U.S. Publication No. 2012/0291368).

It is seen that the overall design of Applicant's tower assembly is to provide tower 12 with a tray 14 engaging the near end 12 of the tower, which tray 14 is adapted to lay upon an outer surface, but not penetrate, a ground elevation, such as the surface of the ground, at the location where the tower assembly is located. That is to say, Applicant provides a tray 14 that is adapted to provide support and stability to tower 12 without penetrating the ground below or near the tower. The tower assembly typically includes ballast 18, which may be a multiplicity of rocks, for example, rocks about ½ inch to 4 or more inches in longest dimension, in which tray has a frame 22, the frame include upstanding perimeter members 30/32/34/36 and a floor 24 welded to or otherwise engaged fully beneath the frame. Thus, in general construction, tray 14 has a floor with upstanding side members, so as to at least partially contain the ballast 18 received therein. Floor 24 may be expanded steel mesh and frame 22 may be comprised of multiple square tubing welded up to one another to form the grid pattern as seen, for example, in FIG. 5A.

Equipment/accessory box 20 may also be provided as part of the tower assembly for engagement with tray 14, which equipment/accessory box 20 may contain electronic equipment and may receive cables from the antenna at the end of the tower.

Frame 22 is seen to include the perimeter members, as well as cross-members 38/40, which cross-members are designed to form a grid pattern and extend from one perimeter member to the opposite, the parallel trending members to provide rigidity and weight to the frame and to help secure ballast. It is seen that perimeter members 30/32/34/36 have some vertical height that act as side walls extending above floor 24 to help prevent lateral movement of the ballast, the ballast preferably providing a weight bearing function to the floor, such that the stabilization weight of the tray and ballast, as well as the moment arms provided by the perimeter, is sufficient to provide stability to the tower so that it will not tip even in a strong wind.

Figures 2A, 2B:
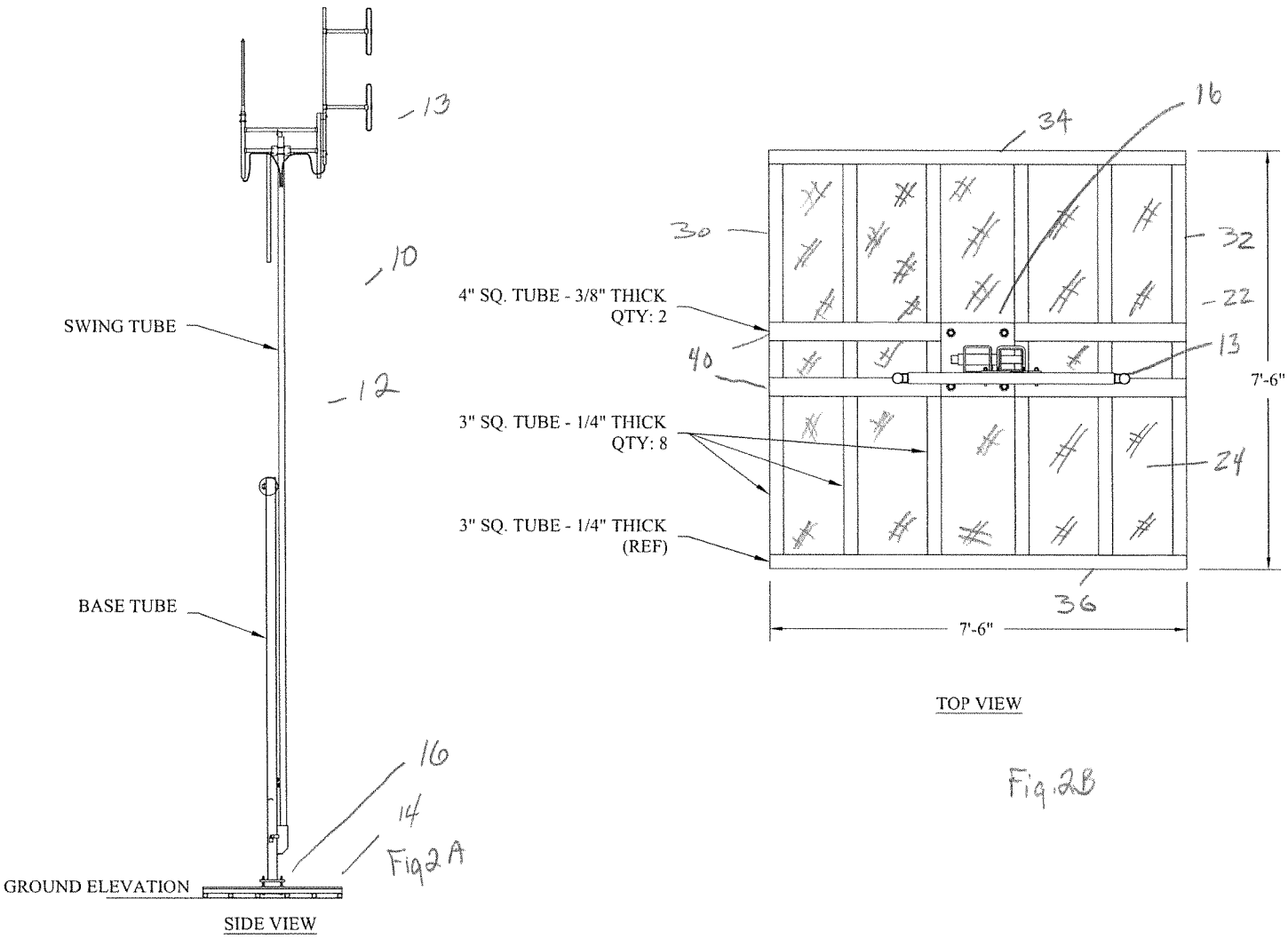
FIGS. 2A and 2B are side and top views of the tower assembly.

It is seen that there are a multiplicity of cross-members 38 and a multiplicity of cross-members 40. It is further seen, for example, with reference to FIG. 2B, that the cross-members may engage, as by welding or other means, the floor and each other, so as to provide a rigid grid-like frame that resists deflection, twisting, bending or other forces applied to it through engagement with the tower.

Figure 4:
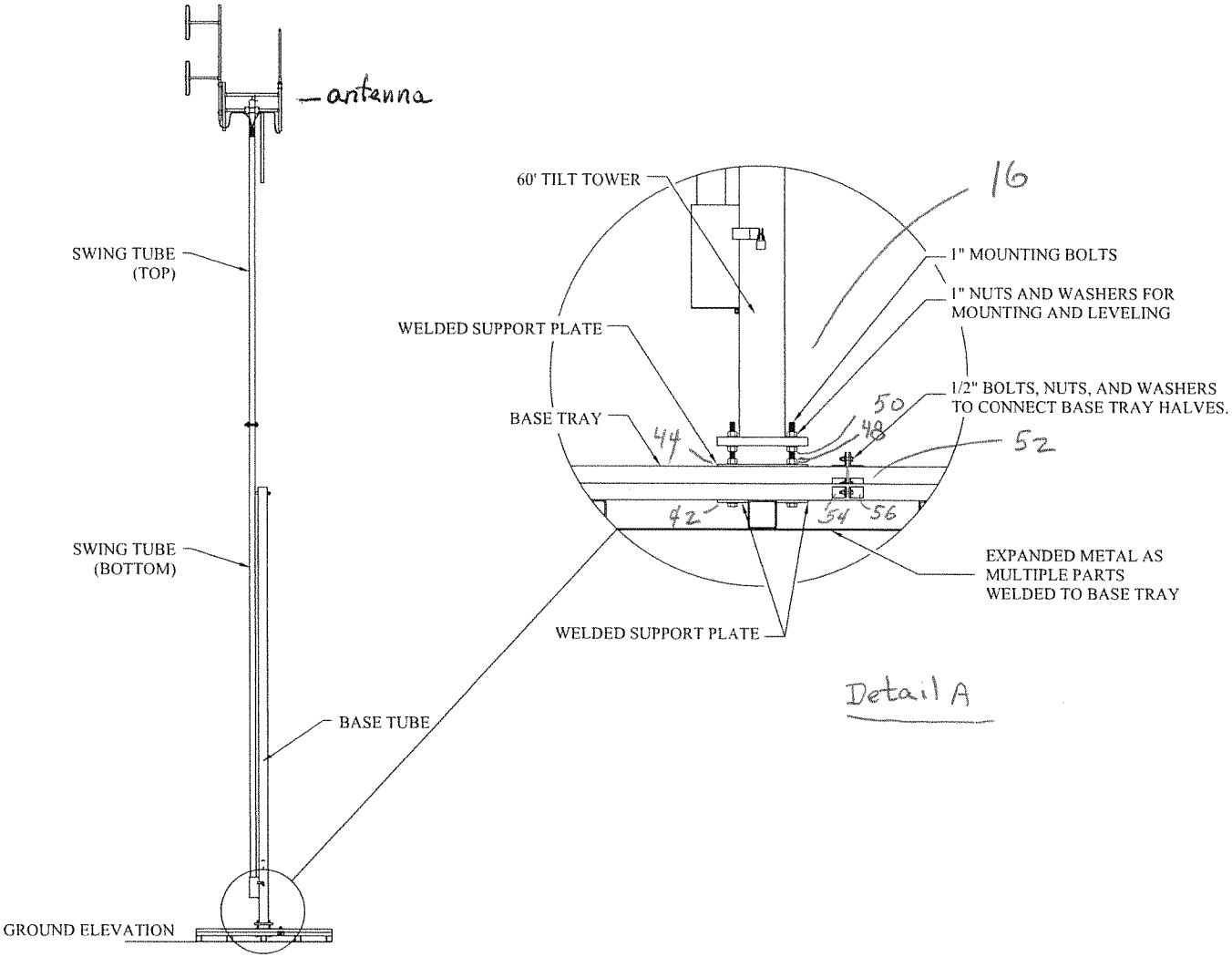
FIGS. 4 and 4 Detail A is another side view with detail showing features of the tray, the tower and method of mounting the tray to the tower.

Some of the details of the mounting assembly are illustrated in FIG. 4. Mounting assembly 16 may include an upper rectangular support plate 44 welded or otherwise mounted to the upper surface of cross-members 40 and a support plate 42 welded to the lower surface of 40 and between cross-members 38*a*/38*b*. A support plate 12*c* may be welded to or otherwise engaged the near end 12*a* of tower 12 and support plate 12*c* may receive a multiplicity of mounting bolts 46 therethrough, which mounting bolts are entrained on holes through plates 42/44/12*a* to securely and directly fasten plate 12*c* and thus tower 12 to frame 22. The direct engagement of plate 12*c* flush against plate 44 is not illustrated, but illustrated in FIG. 4 Detail A is a mounting assembly that provides secure engagement of the tower to the frame, but additionally provides for plate 12*c* to be mounted at a slight angle with respect to the plane of the frame if it is necessary to provide vertical alignment of the tower. This is provided by the use of leveling nuts 50, one each at the four corners abutting lower surface of plate 12*c*, which may be adjusted, with the use of a level, to provide for such vertical alignment with the bolts engaging the top surface of plate 12*c* being tightened down after alignment is provided. Weldments 60 are seen to secure support plates 42/44 to the cross-members 40.

Figure 5B:
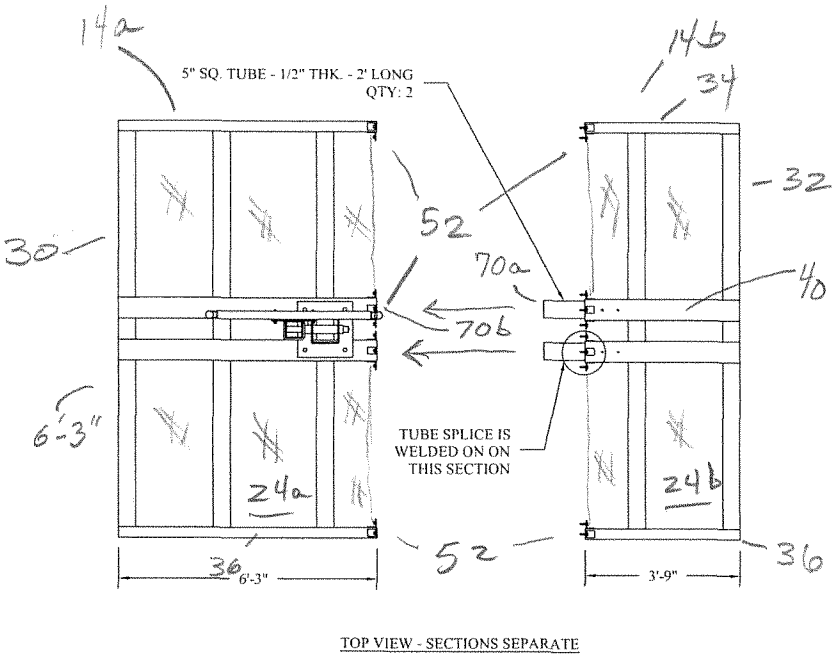
FIGS. 5A, 5A Detail, and 5B are top views showing the breakdown assembly of the tray in assembled form FIG. 5A; in disassembled form FIG. 5B.
FIG. 5C is a perspective view of the breakdown assembly.
Figure 5A:
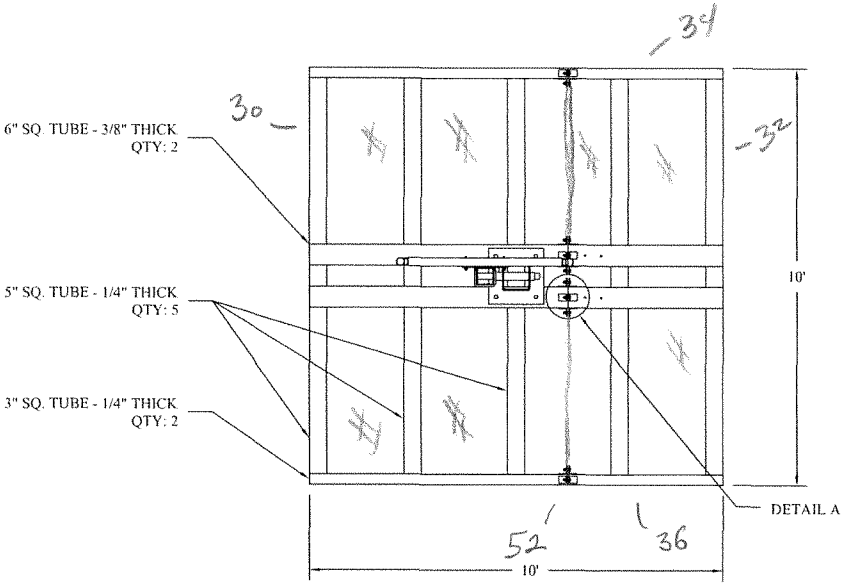
Figures 5A, 5B:
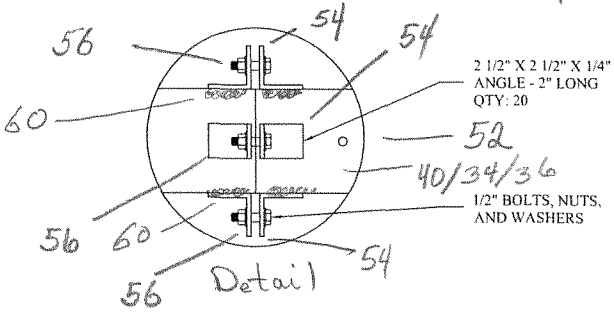
Figure 5C:
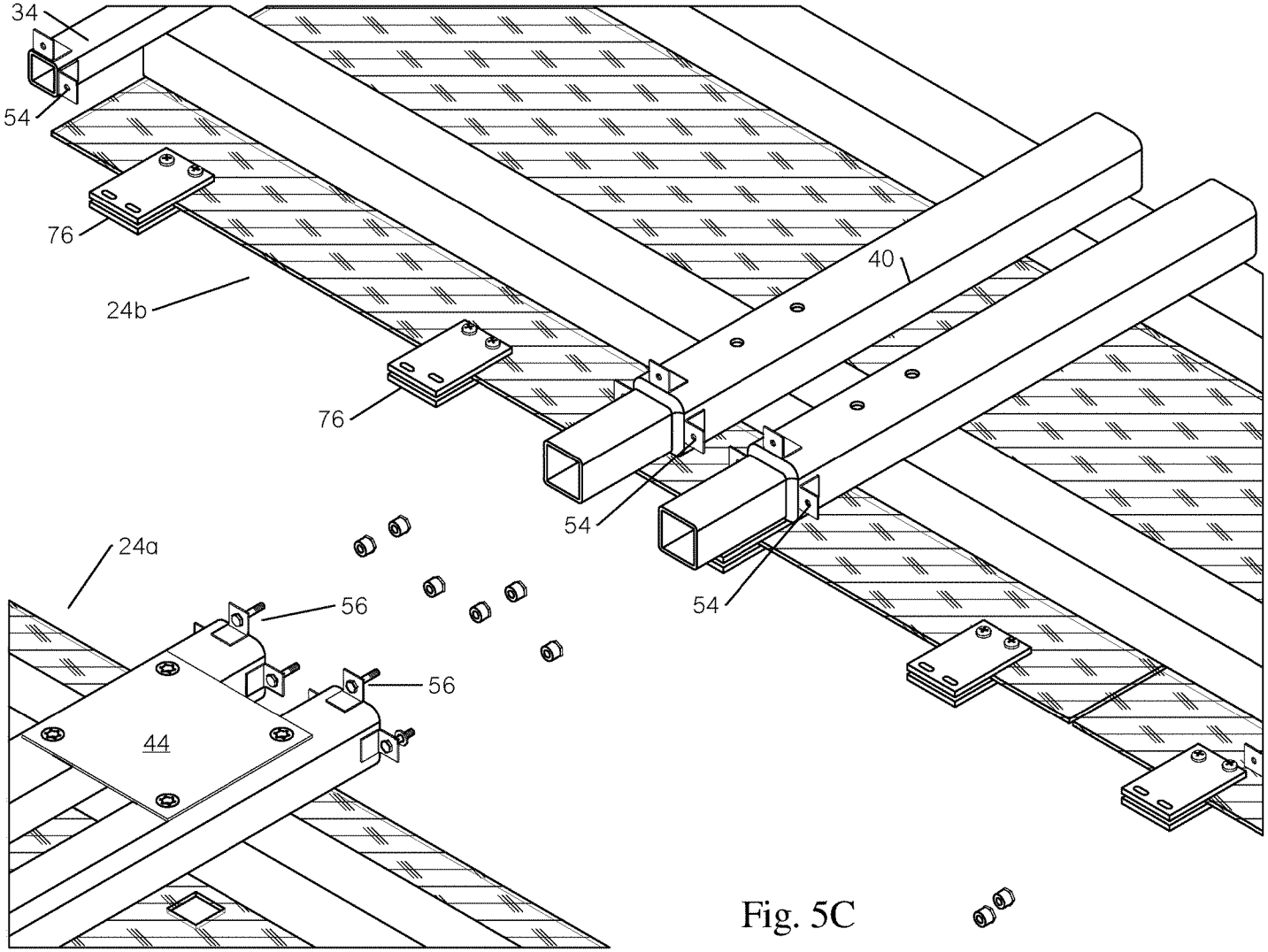

FIGS. 5A, 5B, and 5C illustrate a breakdown assembly 52 for engaging several of the cross-member 40 and perimeter members 34/36 in such a manner that they may disengage tray 14 from one portion 14*a* thereof to the other 14*b*, except the frame may be broken into two sections for ease of shipping. Breakdown assembly 52 may include paired corner brackets 54/56 provided on, typically, three sides of adjacent sections of the cross-members and perimeter members as seen in FIGS. 5A and 5B, with fastener 58 for engaging the paired corner brackets, which may be secured by weldment 60 or other suitable means to the adjacent sections of the cross-members/perimeter members as seen in the Figures. Additionally, the floor is typically cut into two sections 24*a*/24*b*. Note in FIG. 5B, cooperating telescoping members 70*a* (male)/70*b* (female) on at least some of the cross-members. There is seen that the sections of the cross-members and perimeter members are located so as to avoid cutting the mounting plates for mounting assembly. FIG. 5C shows additional optional features, including floor tab/fastener assemblies to engage butting edges of floor sections 24*a*/24*b* together.

Figure 7:
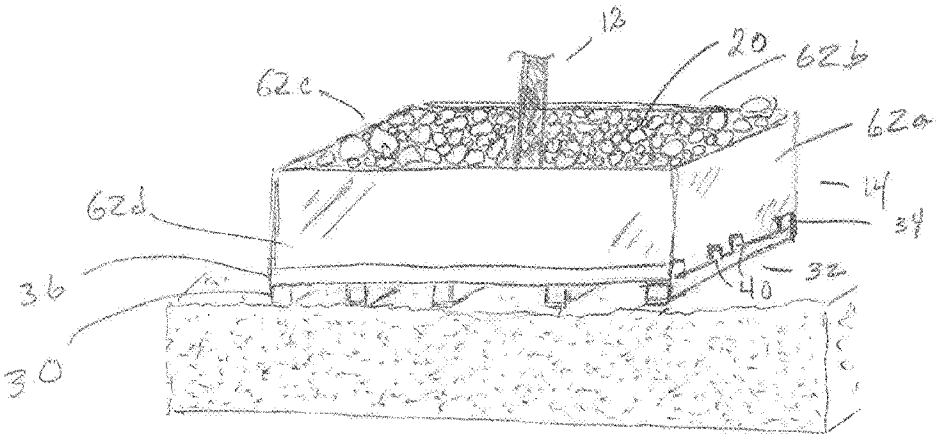
FIG. 7 shows a perspective view of the tray in a high wall embodiment thereof.
Figure 6:
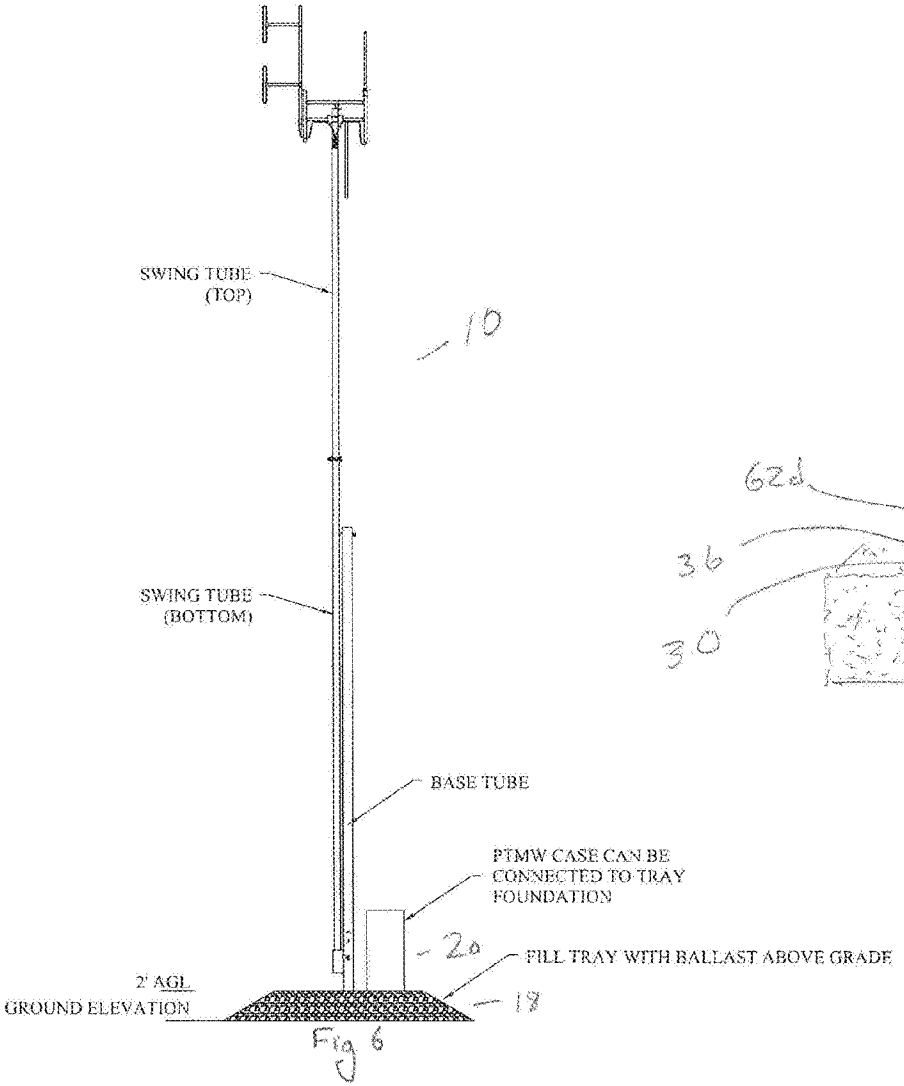
FIG. 6 shows a side view of Applicant's tower assembly with ballast above ground and additional features.
Figures 8A, 8B:
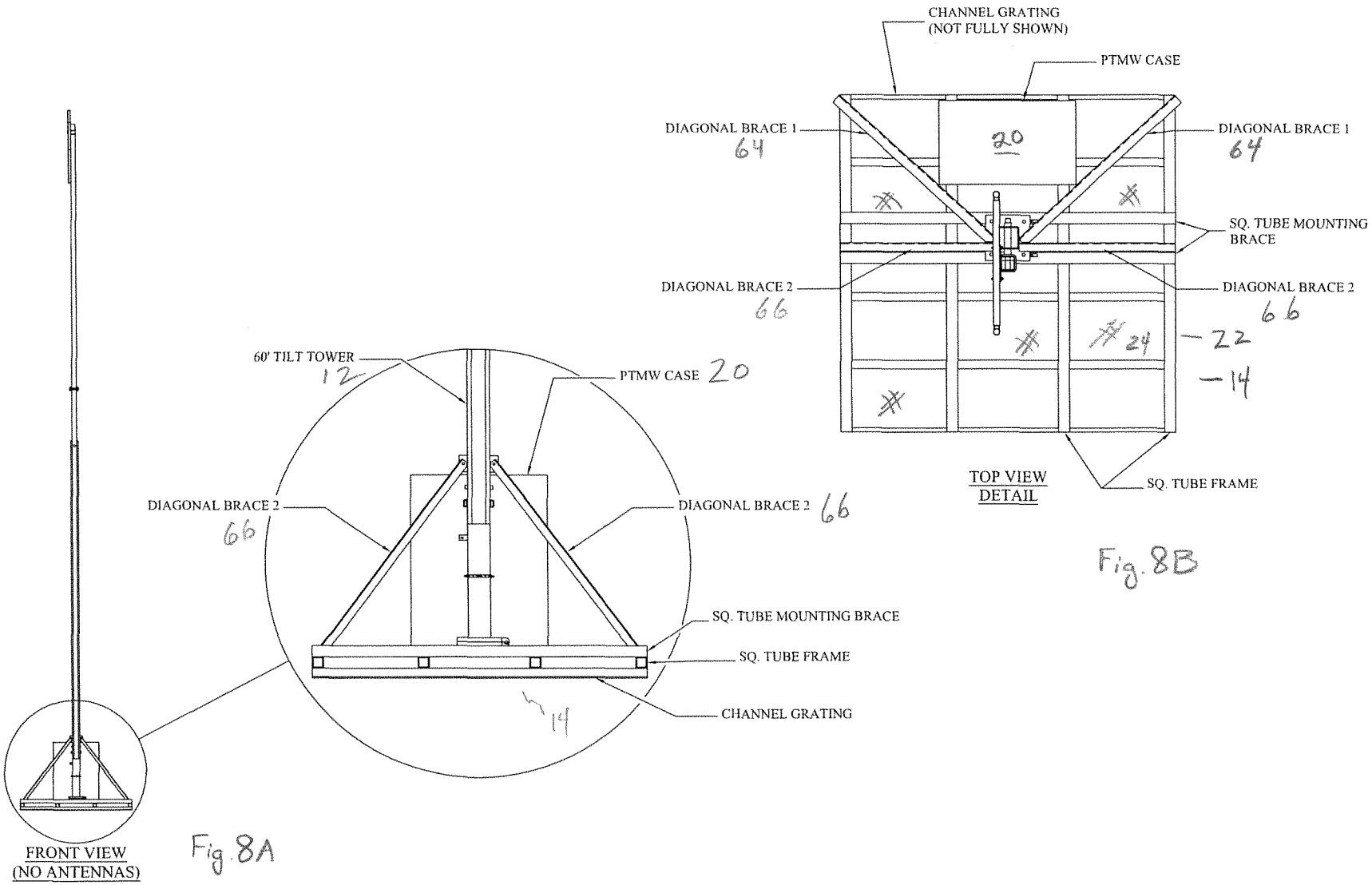
FIGS. 8A, 8A Detail, and 8B illustrate side and top views.

[25] FIG. 7 illustrates for a "high walled" embodiment of frame 22. Perimeter members and cross-members may allow, in the earlier embodiments, walls of several inches high (measured from the floor up). That is, perimeter members, for example, if they are three, four, five or six by rectangular tube stock may provide perimeter side walls of 6' (3"×3" perimeter) up to about 12 inches (6"×6" perimeter). In the embodiment of FIG. 7, side wall members 62*a*-62*d* may extend up the perimeter members, up to 24" or more high, so as to help contain ballast. Upstanding side wall members 62*a*-62*d* may be ¼ or ⅛ inch sheet metal or sheet steel and provide for additional containment of ballast therein. The ballast used may be railroad ballast. This is angular crushed stone, in one case, about 1¾" or 1¼" to about ½" limestone. A flexible member 15 is shown in FIG. 7 for engaging tray 14 and substantially cover the ballast (though here only a portion of the flexible member shown in upper left-hand corner of tray).

FIGS. 8A, 8B, 9 and 10 illustrate that diagonal support braces 64/66 may be used engaging cross-members and/or perimeter members to portions of the lower end of the tower, so as to help provide stability thereto. Diagonal braces may be engaged to plates on the lower end of the tower and may be engaged to perimeters or cross-members by a plate fastener combination (see, for example, detail FIG. 9). Note that braces 64/66 may be asymmetrical in the top view (FIG. 8B) to allow for the swing tube to swing. In monopole applications (no swing tube), braces may be symmetrically arranged around the tower and tray.

Materials for use in the frame perimeter and cross-members may include 3, 4 or 5 inch square tubing or other suitable dimensioned and shaped tubing, ¼ inch, 5/16 inch or ⅜ inch walled or any other suitable wall thickness. I-beams may also be used for the frame. The frame or other metal surface may be galvanized, painted, powder coated or otherwise treated. Guywires (not shown) may extend diagonally downward from the body of the tower to stakes driven into the ground an area away from the tray. Optionally, ballast rock may be soil or other weight providing aggregate.

Figure 3:
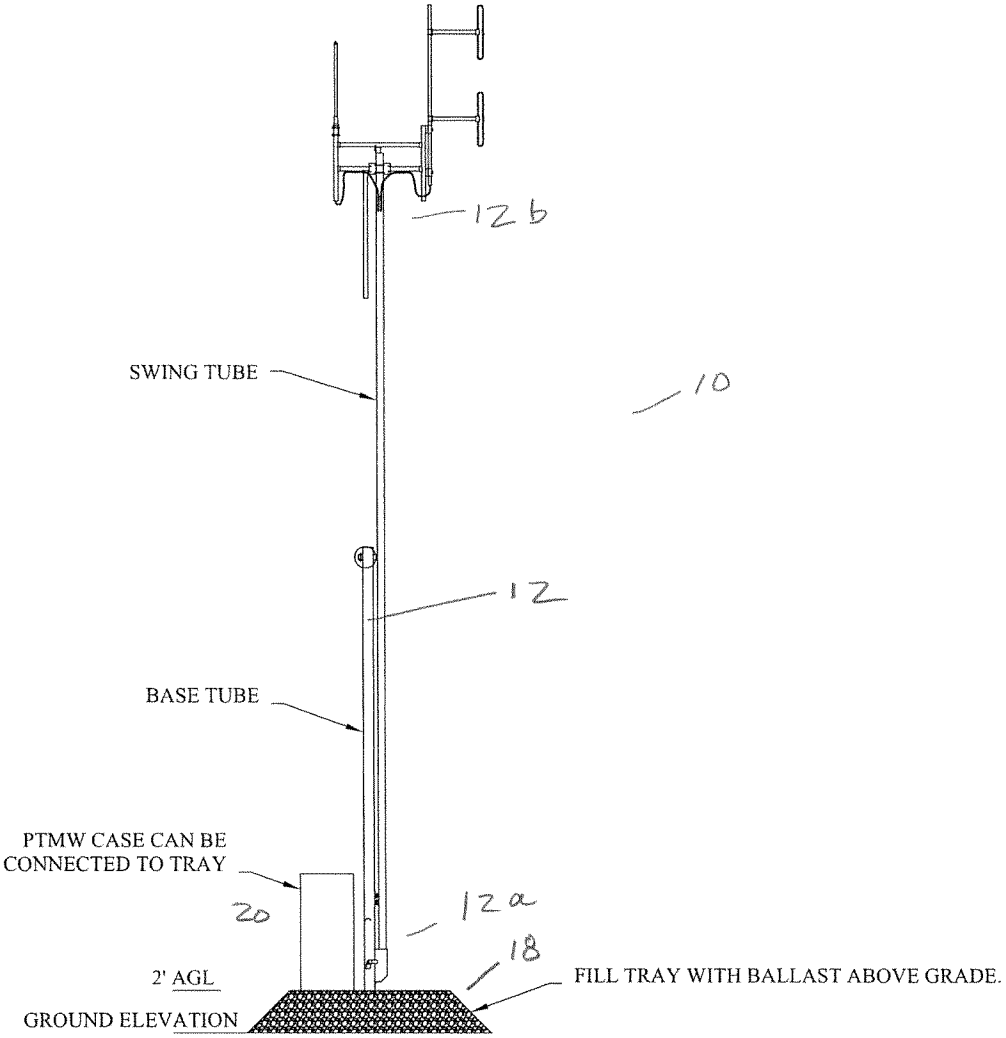
FIG. 3 is a side view of the tower assembly showing the tray stacked or filled with ballast above grade.
Figure 9:
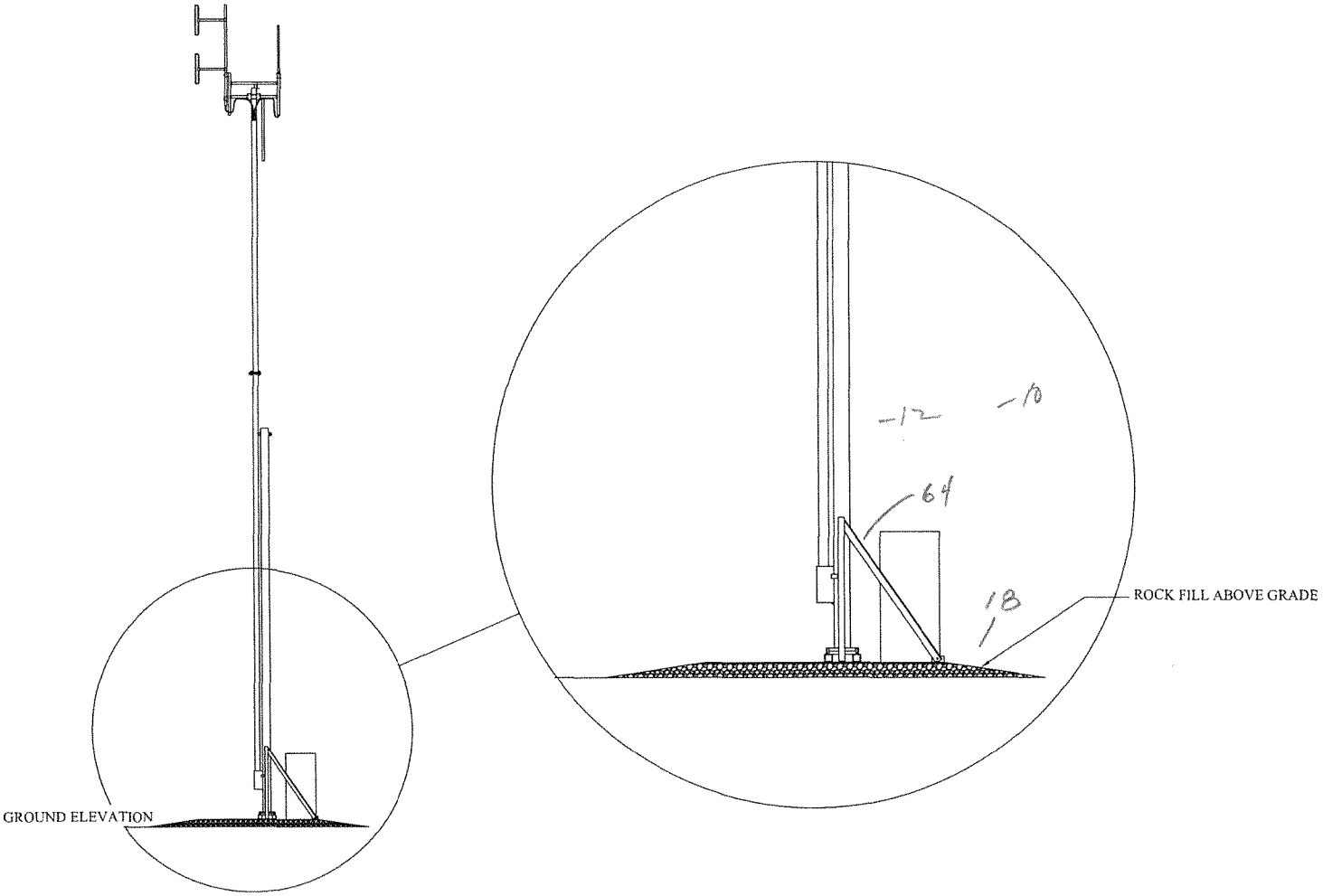
FIG. 9, 9 Detail, FIGS. 10, and 10 Detail are side views of a diagonally braced embodiment of Applicant's tower assembly.
Figure 10:
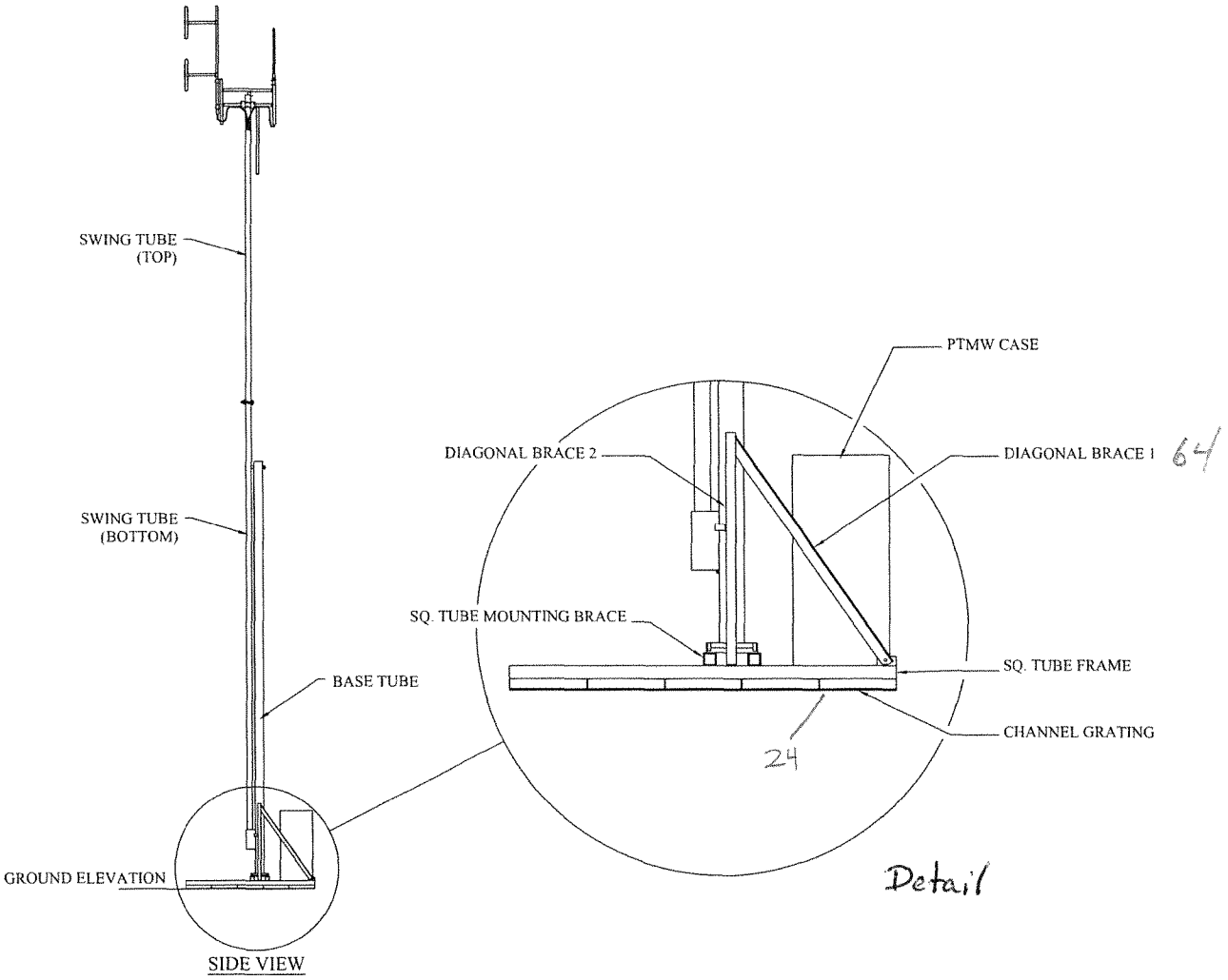

The ballast may be provided with sloped sides (see, for example, in FIG. 3). The trusses or braces as seen in FIGS. 8-10 may be used to help stabilize and decrease the size and/or load of the tray needed. In the drawings, you may see exemplar dimensions and tray sizes (from about 6' on a side to about 10', and below are examples at 40 and 60 foot tower, moment, shear, and axial, with the tray weight with ballast given in Kips (one Kip=1,000 pounds).

60' Tower Tray Foundation
- Tower Base Reactions
- Moment—99.5 Kip-Ft
- Shear—2.8 Kips
- Axial—2.7 Kips
- Tray weight with ballast: about 24 Kips 40' Tower Tray Foundation
- Tower Base Reactions
- Moment—42.1 Kip-Ft
- Shear—1.6 Kips
- Axial—1.6 Kips
- Tray weight with ballast: about 13.5 Kips The above are examples only and different size/weight towers may require different tray and ballast specifications.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A tower assembly for resting on a ground support surface, the tower assembly comprising:
- a tower having a near end and a removed end;
- a tray adapted to engage the tower to provide stability and support to the tower without penetrating the ground;
- ballast comprising aggregate;
  - wherein the tray is comprised of a floor and a frame, the frame comprising multiple perimeter members and multiple cross-members for engaging the floor and perimeter members; and
- a mounting assembly for engaging the tray to the near end of the tower, the mounting assembly comprising a cross-member attached mounting plate engaging at least one cross-member;
  - wherein the ballast covers the floor, the cross-members, and the cross-member attached mounting plate
- wherein the tray includes a first portion and a second portion, and the cross-members of the tray have two portions, each cross-member portion having an inner end and an outer end, the inner ends of the cross-member portions having multiple L-shaped brackets mounted thereon configured to allow the inner ends of each respective cross member to be coupled to each other.

2. The tower assembly of claim 1, wherein the mounting plate is attached to two parallel cross members of the multiple cross members.

3. The tower assembly of claim 1, wherein the portions of the cross-members are only two and wherein the cross-member attached mounting plate engages the longer of the two cross-member portions.

4. The tower assembly of claim 3, wherein the two cross-member portions engage one another telescopically.

5. The tower assembly of claim 1, wherein the near end of the tower includes a tower mounted plate, and wherein the mounting assembly includes multiple fasteners for direct engagement of the tower mounting plate to the cross-member attached mounting plate.

6. The tower assembly of claim 5, wherein the multiple fasteners of the mounting assembly includes multiple bolts and multiple nuts, and wherein at least some of the nuts are entrained on the bolts so as to be between an underside of the tower mounted plate and an upper surface of the cross-member attached mounting plate.

7. The tower assembly of claim 6, wherein the ballast covers the tower mounted plate.

8. The tower assembly of claim 1, wherein the tower comprises a single mast.

9. The tower assembly of claim 8, wherein the single mast includes a swing tube and antenna.

10. The tower assembly of claim 9, further including a flexible member for engaging the tray and substantially covering the ballast.

11. The tower assembly of claim 6, further including a flexible member for engaging the tray and substantially covering the ballast.

12. The tower assembly of claim 4, further including a flexible member for engaging the tray and substantially covering the ballast.

13. The tower assembly of claim 1, wherein the mounting assembly is adapted to plumb (level) the tower.

14. The tower assembly of claim 1, further including a rigid diagonal brace for attaching the tray to the tower.

15. The tower assembly of claim 1, further including an equipment box, the equipment box not covered by the ballast.

16. The tower assembly of claim 1, wherein the ballast comprises multiple loose stones.

17. The tower assembly of claim 16, wherein the multiple loose stones are piled above the perimeter members in a non-level manner.

18. The tower assembly of claim 17, further including a flexible member for engaging the tray and substantially covering the ballast.

19. A tower assembly for resting on a ground support surface, the tower assembly comprising:
- a tower having a near end and a removed end;
- a tray adapted to engage the tower to provide stability and support to the tower without penetrating the ground;
- ballast comprising aggregate;
  - wherein the tray is comprised of a floor and a frame, the frame comprising multiple perimeter members and multiple cross-members for engaging the floor and perimeter members; and
- a mounting assembly for engaging the tray to the near end of the tower, the mounting assembly comprising a cross-member attached mounting plate engaging at least one cross-member;
  - wherein the ballast covers the floor, the cross-members, and the cross-member attached mounting plate;
  - wherein the tray includes a first portion and a second portion, and the cross-members of the tray have two portions, each portion having an inner end and an outer end, the inner ends of the portions having multiple L-shaped brackets thereon to allow the inner ends of each respective cross member to be coupled to each other;
  - wherein the ballast comprises multiple loose stones;
  - wherein the multiple loose stones are piled above the perimeter members in a non-level manner; and
- further including a flexible member for engaging the tray and substantially covering the ballast.

20. A tower assembly for resting on a ground support surface, the tower assembly comprising:

a tower having a near end and a removed end;

a tray adapted to engage the tower to provide stability and support to the tower without penetrating the ground;

ballast comprising aggregate;

wherein the tray is comprised of a floor and a frame, the frame comprising multiple perimeter members and multiple cross-members for engaging the floor and perimeter members; and a mounting assembly for engaging the tray to the near end of the tower, the mounting assembly comprising a cross-member attached mounting plate engaging at least one cross-member;

wherein the ballast covers the floor, the cross-members, and the cross-member attached mounting plate;

wherein the tray includes a first portion and a second portion, the portions removably engaged to one another with fasteners, and the cross-members of the tray have two portions, each portion having an inner end and an outer end, the inner ends of the portions having multiple L-shaped brackets thereon to allow the inner ends of each respective cross member to be coupled to each other;

wherein the near end of the tower includes a tower mounting plate, and wherein the mounted assembly includes multiple fasteners for direct engagement of the tower mounting plate to the cross-member attached plate;

wherein the multiple fasteners of the mounting assembly includes multiple bolts and multiple nuts, and wherein at least some of the nuts are entrained on the bolts so as to be between an underside of the tower mounted plate and an upper surface of the cross-member attached mounting plate; and further including an equipment box, the equipment box not covered by the ballast;

wherein the ballast comprises multiple loose stones.

21. A tower assembly for resting on a ground support surface, the tower assembly comprising:

a tower having a near end and a removed end;

a tray adapted to engage the tower to provide stability and support to the tower without penetrating the ground;

ballast comprising aggregate;

wherein the tray is comprised of a floor and a frame, the frame comprising multiple perimeter members and multiple cross-members for engaging the floor and perimeter members, the cross-members of the tray have two portions, each portion having an inner end and an outer end, the inner ends of the portions having multiple L-shaped brackets thereon to allow the inner ends of each respective cross member to be coupled to each other; and a mounting assembly for engaging the tray to the near end of the tower, the mounting assembly comprising a cross-member attached mounting plate engaging at least one cross-member;

wherein the ballast covers the floor, the cross-members, and the cross-member attached mounting plate;

wherein the near end of the tower includes a tower mounted plate, and wherein the mounting assembly includes multiple fasteners for direct engagement of the tower mounting plate to the cross-member attached mounting plate;

wherein the multiple fasteners of the mounting assembly includes multiple bolts and multiple nuts, and wherein at least some of the nuts are entrained on the bolts so as to be between an underside of the tower mounted plate and an upper surface of the cross-member attached mounting plate;

wherein the ballast covers the tower mounted plate; and wherein the ballast comprises multiple loose stones.

* * * * *